US010917957B1

(12) United States Patent
McReynolds et al.

(10) Patent No.: US 10,917,957 B1
(45) Date of Patent: Feb. 9, 2021

(54) METHOD OF CONFIGURING LIGHTING USING OFFLINE LIGHTING CONFIGURATION TOOL

(71) Applicant: Lumileds LLC, San Jose, CA (US)

(72) Inventors: Alan Andrew McReynolds, San Jose, CA (US); Yifeng Qiu, San Jose, CA (US)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/729,120

(22) Filed: Dec. 27, 2019

(51) Int. Cl.

| | |
|---|---|
| ***H05B 47/14*** | (2020.01) |
| ***H05B 47/165*** | (2020.01) |
| ***H05B 45/44*** | (2020.01) |
| ***H05B 45/24*** | (2020.01) |
| ***H05B 45/20*** | (2020.01) |
| ***H05B 47/19*** | (2020.01) |

(52) U.S. Cl.
CPC ..... *H05B 47/14* (2020.01); *H05B 45/24* (2020.01); *H05B 45/44* (2020.01); *H05B 47/165* (2020.01)

(58) Field of Classification Search
CPC ..... H05B 45/20; H05B 47/19; H05B 47/10; H05B 45/10; H05B 47/11; H05B 45/50; H05B 45/37; H05B 45/46; H05B 47/105; H05B 45/48; H05B 47/175
USPC ..... 315/297, 291, 151, 307, 122, 152, 153
See application file for complete search history.

(56) References Cited

U.S. PATENT DOCUMENTS

| | | | | |
|---|---|---|---|---|
| 2002/0130627 | A1* | 9/2002 | Morgan | F21K 9/23 315/291 |
| 2006/0087843 | A1 | 4/2006 | Setomoto et al. | |
| 2016/0323972 | A1* | 11/2016 | Bora | F21V 23/06 |
| 2016/0374168 | A1* | 12/2016 | Ackmann | H05B 45/37 |

OTHER PUBLICATIONS

"U.S. Appl. No. 16/729,101, Ex Parte Quayle Action mailed Apr. 15, 2020", 7 pgs.
"U.S. Appl. No. 16/729,101, Notice of Allowance dated Jun. 26, 2020", 11 pgs.
"U.S. Appl. No. 16/729,101, Response filed Jun. 11, 2020 to Ex Parte Quayle Action mailed Apr. 15, 2020", 11 pgs.
U.S. Appl. No. 16/729,101, filed Dec. 27, 2019, Offline Lighting Configuration Tool.

* cited by examiner

*Primary Examiner* — Wei (Victor) Y Chan
(74) *Attorney, Agent, or Firm* — Schwegman Lundberg & Woessner, P.A.

(57) ABSTRACT

An LED circuit board, system, and method of using an LED configuration tool are described. The LED circuit board contains a microprocessor that wakes up when power is supplied from the tool. The microprocessor determines that the tool is present by sending a signal from one pin and detecting whether the same signal is received at another pin. When analog or digital programming information received from the tool indexes the information in a table of the microprocessor or also uses a new table provided by digital programming information, the programming information is used to change a lighting configuration of the LEDs. Feedback from the microprocessor to the tool provides information regarding the status of programming the microprocessor.

24 Claims, 10 Drawing Sheets

METHOD OF CONFIGURING LIGHTING USING OFFLINE LIGHTING CONFIGURATION TOOL

CROSS REFERENCE TO RELATED APPLICATION

This application is related to commonly assigned U.S. patent application Ser. No. 16/729,101, entitled "Offline Lighting Configuration Tool," filed on Dec. 27, 2019.

TECHNICAL FIELD

The present disclosure relates to lighting. Some embodiments relate to light emitting diodes (LEDs) and programming of LEDs.

BACKGROUND

The use of LEDs for a wide variety of lighting has exploded in the last decade due to advances in LED quality and cost reduction in producing the LEDs, fixtures, and systems that include the LEDs. Lighting systems that use LEDs have desirable qualities over non-LED lighting systems, including enhanced controllability and increased energy efficiency. LED parameters are typically programmed prior to or during assembly of a fixture that contains the LEDs as such programming may be a time or labor-intensive process that uses specialized equipment. This methodology may also lead to estimating short and long-term demand for different fixtures, with incumbent issues of warehousing excess product and increased product delivery time (and concomitant potential loss of sale) surrounding incorrect estimates.

BRIEF DESCRIPTION OF THE DRAWINGS

In the figures, which are not necessarily drawn to scale, like numerals may describe similar components in different views. Like numerals having different letter suffixes may represent different instances of similar components. The figures illustrate generally, by way of example, but not by way of limitation, various aspects discussed in the present document.

Figure 1:
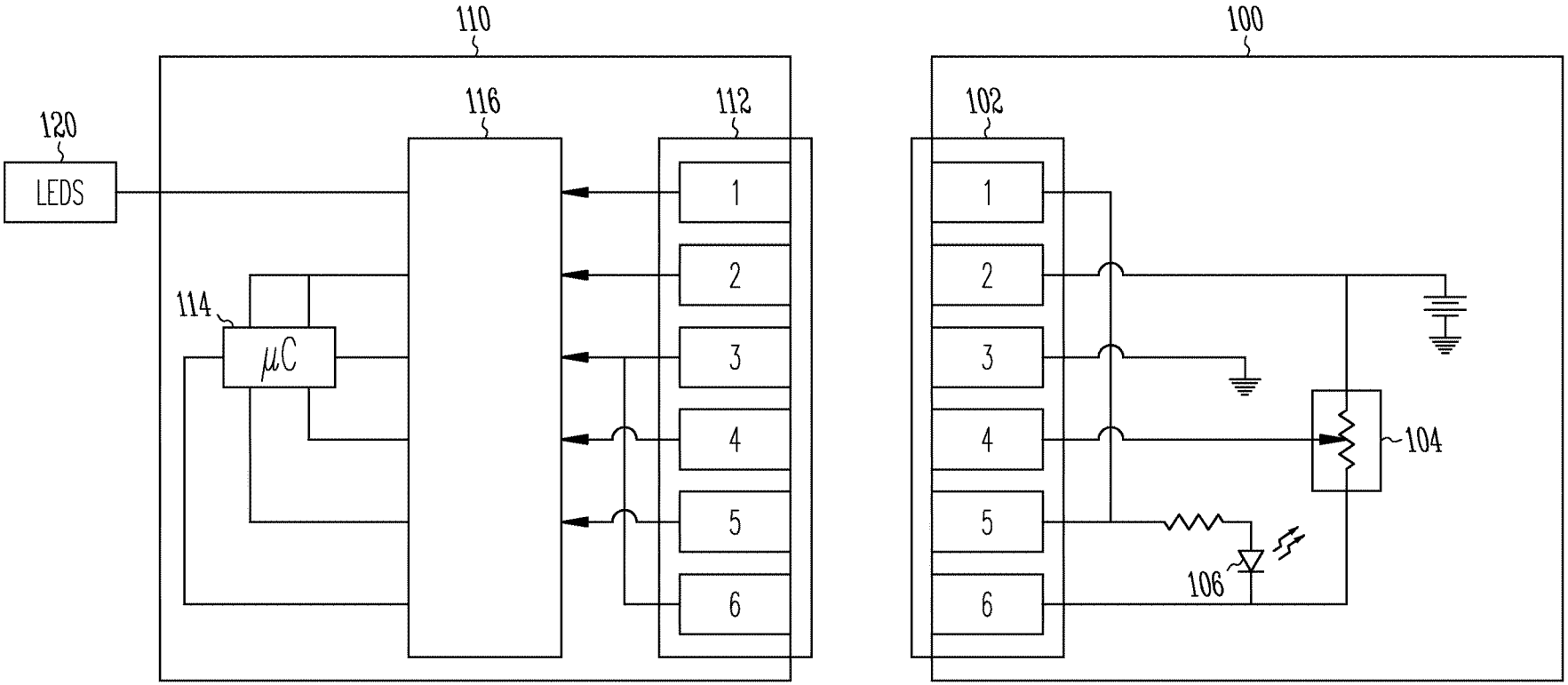
FIG. 1 shows circuitry of an LED programming system in accordance with some embodiments.

Corresponding reference characters indicate corresponding parts throughout the several views. Elements in the drawings are not necessarily drawn to scale. The configurations shown in the drawings are merely examples, and should not be construed as limiting the scope of the disclosed subject matter in any manner.

DETAILED DESCRIPTION

The following description and the drawings sufficiently illustrate specific aspects to enable those skilled in the art to practice them. Other aspects may incorporate structural, logical, electrical, process, and other changes. Portions and features of some aspects may be included in, or substituted for, those of other aspects. Aspects set forth in the claims encompass all available equivalents of those claims.

As discussed above, the diversity of uses and locations of LED lighting has expanded in the last several years as the efficiency has increased and costs decreased. Generally, lighting manufacturers create or assemble a large variety of fixtures and products for purchase, in which the LED parameters are programmed prior to being shipped to the customer. The LED parameters are typically programmed prior to or during assembly of a fixture that contains the LEDs, as such programming may be a time or labor-intensive process that uses specialized equipment under the control of the manufacturer. This creates inefficiencies both at the manufacturing and consumer end as estimations of short and long-term demand for different fixtures or product lines that are incorrect may lead to the incumbent issues of warehousing excess product and increased product delivery time (and concomitant potential loss of sale). Moreover, even though the lighting is capable of being changed by changing the LED parameters, in a number of cases, once the product is installed at an on-site location, the operator may be unable to change the lighting due to the lack of special equipment, knowledge, or difficultly in reaching the circuit board itself. The use of a configuration tool may thus enable particular lighting to be created at a luminaire assembly plant, for example, rather than by a LED or circuit board manufacturer. This may also allow the circuit board manufacturer to create large numbers of generic boards to ship for later programming instead of specialized boards.

FIG. 1 shows circuitry of an LED programming system in accordance with some embodiments. The programming system includes a lighting configuration tool (also referred to as an LED configuration tool) 100 and a circuit board 110. The configuration tool 100 includes multiple contacts 102, programming circuitry 104, and feedback circuitry 106.

The contacts 102 may be male and/or female contacts and are configured to mate with corresponding contacts of the circuit board 110. Note that although six contacts are shown in FIG. 1, in other embodiments, the number of contacts may differ. The contacts 102 may include a verification contact (contact 1), a power contact (contact 2), a ground contact (contact 3), a programming contact (contact 4), a feedback contact (contact 5), and a sink contact (contact 6). Each of these contacts have corresponding contacts on the circuit board, as discussed in more detail below. As shown, the verification contact and the feedback contact are coupled together. The power contact is coupled to a battery and the ground contact is grounded. In addition, in other embodiments, the contacts and circuitry may be arranged in a different manner than that shown in FIG. 1.

The programming circuitry 104 provides LED programming information via the programming contact to a microprocessor 114 on the circuit board 110 when the configuration tool 100 is connected to the circuit board 110. The LED programming information corresponds to a plurality of parameters used for each of a plurality of LEDs 120 controlled by the microprocessor 114. In FIG. 1, the programming circuitry 104 is an analog circuit connected between power (the power contact) and the sink (the sink contact). Specifically, the programming circuitry 104 shown is a variable resistor whose value is fixed to a predetermined resistance. Despite the programming circuitry 104 being a variable resistor, the resistance of the variable resistor may be set when the configuration tool 100 is fabricated or, at least, prior to sending the configuration tool 100 to the location where the configuration tool 100 is to be used. However, the variable resistor, while accessible when the configuration tool 100 is initially programmed, may be inaccessible or otherwise unable to be reprogrammed in the field (e.g., the location where the LEDs are installed [on-site location] or sold, rather than at the manufacturer or assembly location). For example, a special access tool may be used to access the physical location where the variable resistor is disposed. The resistance provided by the variable resistor may be calibrated to be within a predetermined acceptable range for the LED lighting to be programmed.

The feedback circuitry 106 provides feedback to a user of the configuration tool 100 regarding programming of the microprocessor 114 on the circuit board 110. In FIG. 1, the feedback circuitry 106 is positioned between the feedback contact and the sink contact. The microprocessor 114 provides an indication (feedback signal) via the feedback contact of the interaction between the configuration tool 100 and the circuit board 110. This interaction changes dependent on what information is being conveyed by the microprocessor 114. For example, the feedback signal may indicate whether the configuration tool 100 and the circuit board 110 are properly connected or may indicate a status of programming of the microprocessor 100. The feedback circuitry 106 may include, as shown, one or more LEDs that are configured to provide a different output dependent on the interaction. In other embodiments, the configuration tool 100 may be configured to provide tactile feedback and/or audible feedback in addition to or instead of the visual feedback provided by the LED(s).

The circuit board 110 includes contacts 112 that mate with contacts 102 of the configuration tool 100, the microprocessor 114, and interface circuitry 116. The interface circuitry 116 may include drivers or other circuitry used to drive the LEDs 120, as well as filters, amplifiers, buffers, or other circuits used to adequately receive the LED programming information from the configuration tool 100 or send the feedback signal to the configuration tool 100, for example. A sink contact on the circuit board 110 is coupled to a ground contact on the circuit board 110 to form a secondary ground contact and thereby ground the circuitry connected to the sink contact of the configuration tool 100 when the circuit board 110 and the configuration tool 100 are connected. As shown, this circuitry includes both the feedback circuitry 106 and the programming circuitry 104.

The microprocessor 114 controls the LEDs 120 such that the LEDs 120 provide a desired output. The microprocessor 114 (or memory accessed by the microprocessor 114) contains a table having discrete values or ranges of values. The ranges in the table are indexed to valid configurations of multiple parameters used to operate the LEDs 120, with invalid ranges at the extremes and between the valid ranges. The LED configurations can include, for example, a configuration to provide specific color points (correlated color temperature (CCT) & Duv (defined in ANSI C78.377 as the distance from the black body line (BBL))), flux, dimming curve, warm dimming curve, wake-up curve, or daylight CCT following. The LED programming information may thus not only provide a configuration (parameters) for driving the LEDs but may in addition enable previously features (such as the ability to adjust color tuning as the flux changes). For example, the different values may indicate different CCT color points such as: Value A: Fixed 2700 CCT; Value B: Fixed 3000 CCT; Value C: Fixed 3500 CCT; Value D: Fixed 4000 CCT; Value E: Dim-to-warm curve (5000 CCT→1800 CCT). In another example, different lighting can be used in different supermarket/grocery store displays, allowing for in-situ reconfiguration of display lighting at the on-site location. In this case, an example may be Value A: Produce; Value B: Fish; Value C: Marbled Meat; Value D: Red Meat; Value E: Bread & Pastries.

The microprocessor 114 may be any microprocessor capable of executing instructions (sequential or otherwise) that specify actions to be taken by the circuit board 110. The configuration tool 100 and/or circuit board 110 may contain logic and various components and modules on which the microprocessor 114 may operate. Modules and components are tangible entities (e.g., hardware) capable of performing specified operations and may be configured or arranged in a certain manner. In an example, circuits may be arranged (e.g., internally or with respect to external entities such as other circuits) in a specified manner as a module. The microprocessor 114 may be configured by firmware or software (e.g., instructions, an application portion, or an application) as a module that operates to perform specified operations. In an example, the software may reside on a machine readable medium, such as a non-statutory machine readable medium. In an example, the software, when executed by the underlying hardware of the module, causes the hardware to perform the specified operations.

Accordingly, the term "module" (and "component") is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

The configuration tool 100 and/or circuit board 110 may further contain one or more memories, some or all of which may communicate with each other via an interlink (e.g., bus) (hereafter referred to as a memory for convenience). The memory may be removable storage, non-removable storage, volatile memory, and/or non-volatile memory. The configuration tool 100 and/or circuit board 110 may further include input/output (I/O) modules such as a display unit (e.g., a video display), an alphanumeric input device (e.g., a keyboard), or a user interface (UI) navigation device. The configuration tool 100 and/or circuit board 110 may further contain a signal generation device (e.g., a speaker), a network interface device, and one or more sensors, such as a global positioning system (GPS) sensor, compass, accelerometer, or one or more other sensors. The configuration tool 100 and/or circuit board 110 may further include an output controller, such as a serial (e.g., universal serial bus (USB), parallel, or other wired or wireless (e.g., cellular, WiFi, infrared (IR), near field communication (NFC)) connection to communicate or control one or more peripheral devices (e.g., a printer).

The memory may include a non-transitory machine-readable medium on which is stored one or more sets of data structures or instructions (e.g., software) embodying or utilized by any one or more of the techniques or functions described herein. The instructions may also reside, successfully or at least partially, within the microprocessor 114 during execution thereof by the microprocessor 114. The term "machine-readable medium" may include a single medium or multiple media (e.g., a centralized or distributed database, and/or associated caches and servers) configured to store the one or more instructions.

The term "machine-readable medium" may include any medium that is capable of storing, encoding, or carrying instructions for execution by the communication device and that cause the configuration tool 100 and/or circuit board 110 to perform any one or more of the methods described herein, or that is capable of storing, encoding, or carrying data structures used by or associated with such instructions. Non-limiting machine-readable medium examples may include solid-state memories, and optical and magnetic media. Specific examples of machine-readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); and CD-ROM and DVD-ROM disks.

The configuration tool 100 and/or circuit board 110 may further be able to communicate over a communications network using a transmission medium via a network interface utilizing any one of a number of transfer protocols (e.g., frame relay, internet protocol (IP), transmission control protocol (TCP), user datagram protocol (UDP), hypertext transfer protocol (HTTP)). Example communication networks may include a local area network (LAN), a wide area network (WAN), a packet data network (e.g., the Internet), mobile telephone networks (e.g., cellular networks), Plain Old Telephone (POTS) networks, and wireless data networks. Communications over the networks may include one or more different protocols, such as Institute of Electrical and Electronics Engineers (IEEE) 802.11 family of standards known as Wi-Fi, IEEE 802.16 family of standards known as WiMax, IEEE 802.15.4 family of standards, a Long Term Evolution (LTE) family of standards, a Universal Mobile Telecommunications System (UMTS) family of standards, peer-to-peer (P2P) networks, a NG/NR standards among others. In an example, the network interface device may include one or more physical jacks (e.g., Ethernet, coaxial, or phone jacks) or one or more antennas to connect to the transmission medium.

The microprocessor 114 is able to reconfigure its I/O configuration (pinout) dependent on what the microprocessor 114 detects is connected to the circuit board 110. For example, the I/O configuration of the microprocessor 114 changes if the microprocessor 114 detects that the tool connected to the circuit board 110 is the configuration tool 100 to permit the LED programming information to be received via the programming contact.

In some embodiments, the circuit board 110 may not contain its own independent power source. This is to say that the battery on the configuration tool 100 may be used to "wake up" and power the microprocessor 114.

Figure 2:
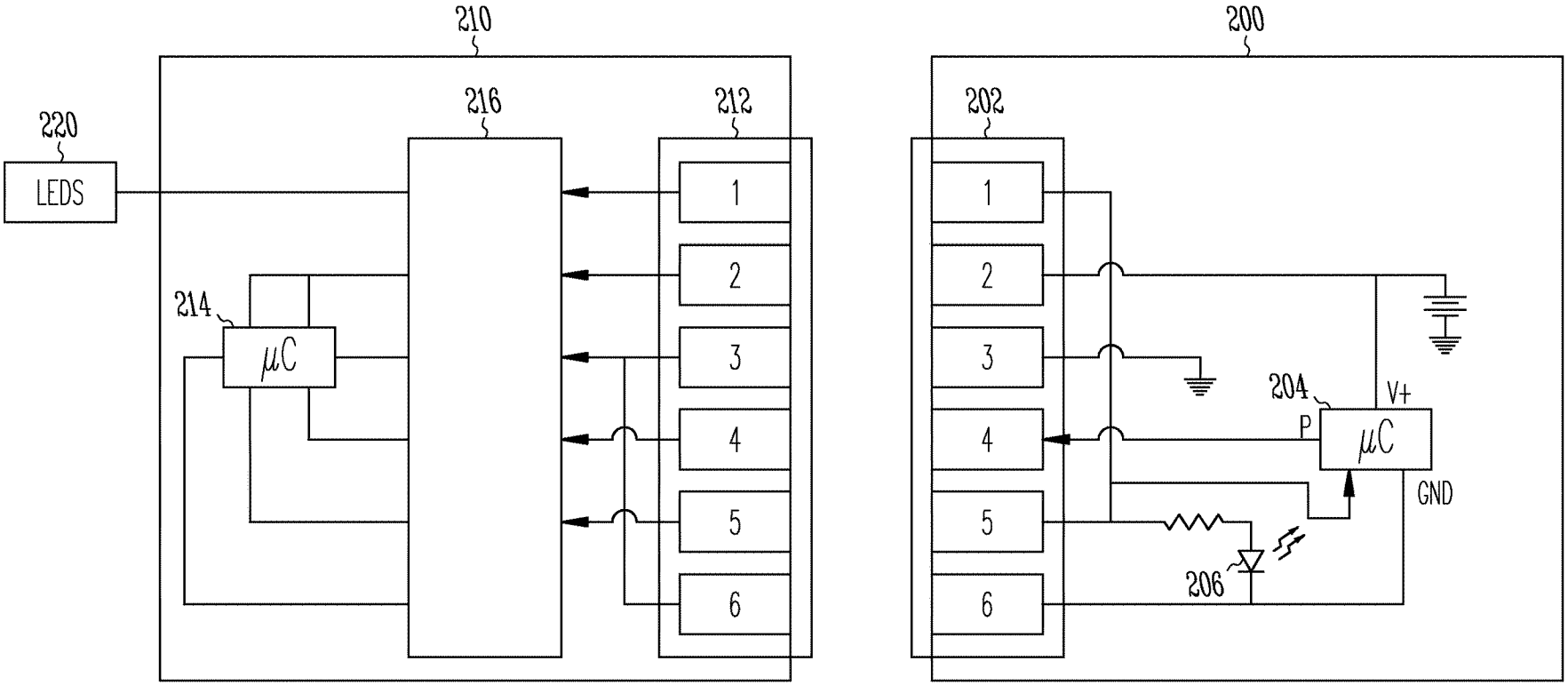
FIG. 2 shows circuitry of another LED programming system in accordance with some embodiments.

FIG. 2 shows circuitry of another LED programming system in accordance with some embodiments. The embodiment shown in FIG. 2 is similar to that shown in FIG. 1. As discussed above, the programming system includes configuration tool 200 and a circuit board 210. The configuration tool 200 includes multiple contacts 202, programming circuitry 204, and feedback circuitry 206.

The contacts 202 may be male contacts (pins) and/or female contacts and are configured to mate with contacts of the circuit board 210. The contacts 202 may include a verification contact (contact 1), a power contact (contact 2), a ground contact (contact 3), a programming contact (contact 4), a feedback contact (contact 5) and a sink contact (contact 6). The verification contact and the feedback contact are coupled together. The power contact is coupled to a battery and the ground contact is grounded.

The programming circuitry 204 provides the LED programming information via the programming contact to a microprocessor 214 on the circuit board 210 when the configuration tool 200 is connected to the circuit board 210. Unlike FIG. 1, in FIG. 2, the programming circuitry 204 comprises a digital circuit positioned between the power contact and the sink contact. Specifically, the programming circuitry 204 shown is a programming microprocessor that provides a digital, rather than analog, signal to the microprocessor 214 of the circuit board 210. Unlike the analog signal, the digital signal may include more information than merely a value to be indexed to determine the configuration to use; for example, as explained in more detail below, the digital signal may include a new table to replace the table already stored in the microprocessor 214 and/or a license information update for a number of times the microprocessor 214 is able to be updated.

The feedback circuitry 206 provides feedback to a user of the configuration tool 200 regarding programming of the microprocessor 214 on the circuit board 210. The feedback circuitry 206 is coupled between the feedback contact and the sink contact. The microprocessor 214 provides the feedback signal via the feedback contact of the interaction between the configuration tool 200 and the circuit board 210. The feedback circuitry 206 may comprise one or more LEDs that are configured to provide a different output dependent on the interaction.

The circuit board 210 includes contacts 212 that mate with contacts 202 of the configuration tool 200, the microprocessor 214, and interface circuitry 216. The interface circuitry 216 may include drivers or other circuitry used to drive the LEDs 220, as well as filters, amplifiers, buffers, or other circuits used to adequately receive the LED programming information from the configuration tool 200 or send the feedback signal to the configuration tool 200, for example. The sink contact on the circuit board 210 is coupled to the ground contact on the circuit board 210, thereby grounding the circuitry connected to the sink contact of the configuration tool 200 when the circuit board 210 and the configuration tool 200 are connected. This circuitry includes both the feedback circuitry 206 and the programming circuitry 204.

The microprocessor 214 controls the LEDs 220 such that the LEDs 220 provide a desired output. The microprocessor 214 (or memory accessed by the microprocessor 214) contains a table of configurations associated with different digital signals. The values in the table correspond to valid configuration values for an LED configuration of the LEDs 220.

The microprocessor 214 is able to reconfigure its I/O configuration (pinout) dependent on what the microprocessor 214 detects is connected to the circuit board 210. The circuit board 210 may not contain its own independent power source, in which case a battery on the configuration tool 200 may be used to "wake up" and power the microprocessor 214.

Figure 3A:
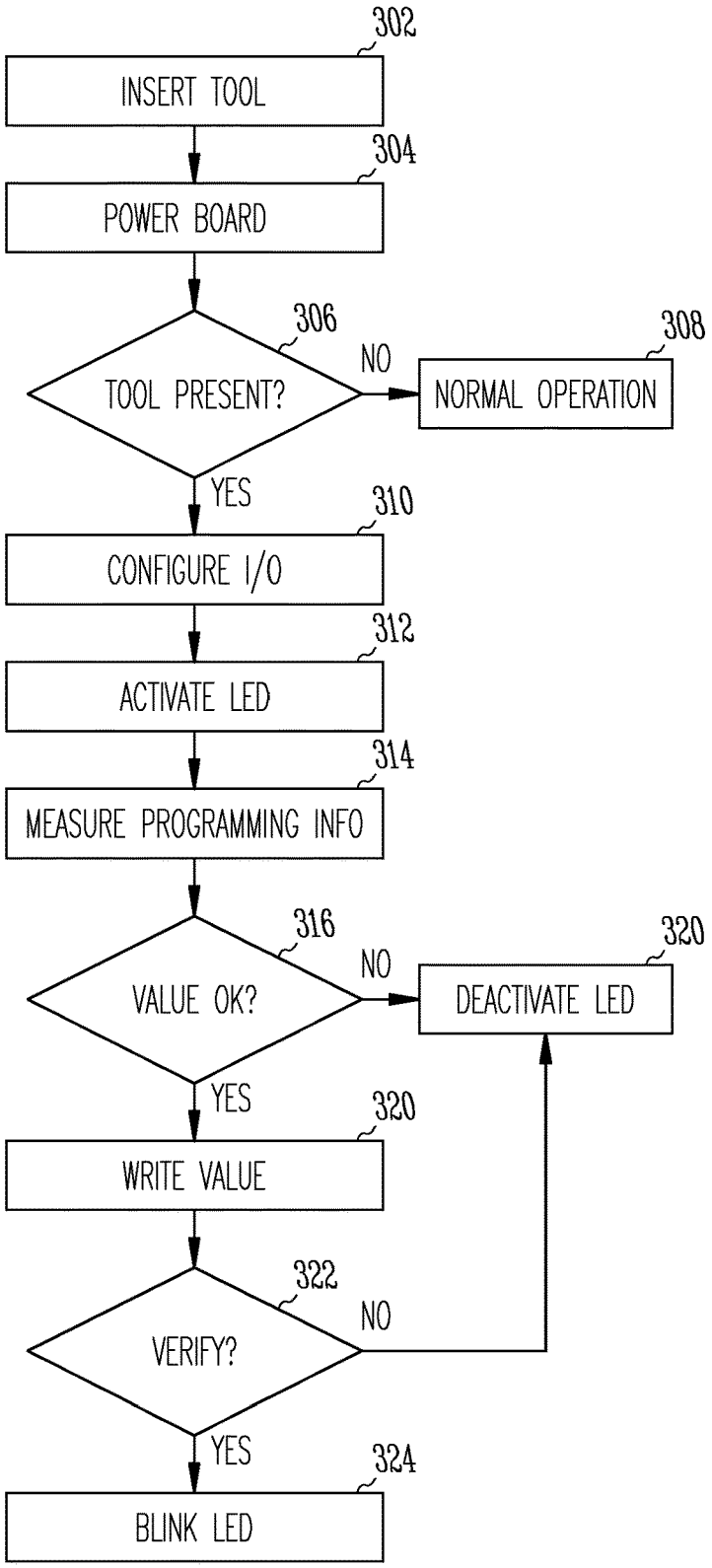
FIG. 3A shows a flowchart of a method of programming LEDs performed by a circuit board in accordance with some embodiments.
Figure 3B:
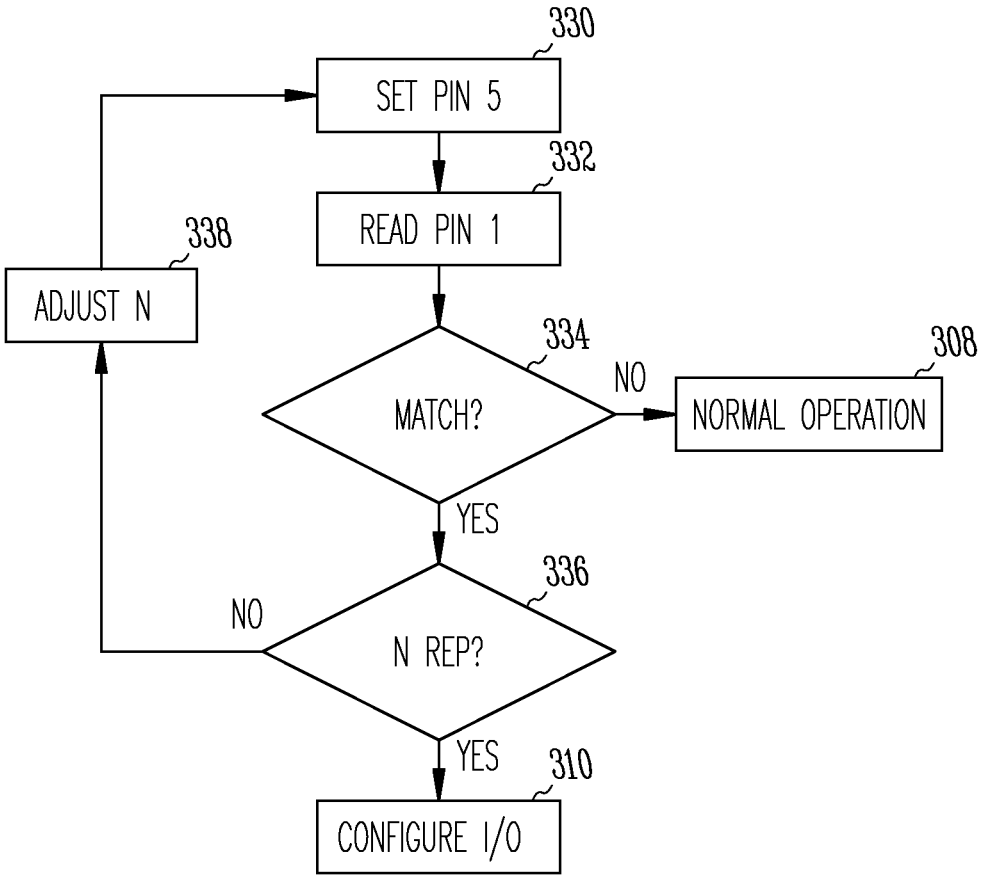
FIG. 3B shows a portion of the flowchart of the method of FIG. 3A in which the circuit board determines the presence of a configuration tool in accordance with some embodiments.

FIG. 3A shows a flowchart of a method of programming LEDs performed by a circuit board in accordance with some embodiments. FIG. 3B shows a portion of the flowchart of the method of FIG. 3A in which the circuit board determines presence of a configuration tool in accordance with some embodiments. FIGS. 3A and 3B correspond to the system shown in FIG. 1, in which the configuration tool provides an analog signal as the LED programming information. The operations shown in FIG. 3A may be implemented by the microprocessor, which may have loaded the instructions for the operations from nonvolatile memory to volatile memory, and afterwards started executing the instructions. The method shown here, and any method described herein, may include one or more operations, functions, or actions illustrated by one or more blocks. Although the blocks are illustrated in sequential orders, these blocks may also be performed in parallel and/or in a different order than those described herein. Also, the various blocks may be combined into fewer blocks, divided into additional blocks, and/or eliminated based upon the desired implementation.

The configuration tool may be used to program the circuit board at any point after the circuit board and LEDs are connected. Thus, the configuration tool may be used to program the circuit board during fabrication of the fixture in which the circuit board is disposed (e.g., at the factory) or later. A latter location may include at the point of sale to a consumer or in the field where the light source is to operate. At operation 302, an operator who has received the configuration tool physically inserts the configuration tool into the circuit board. In other embodiments, the configuration tool and circuit board may also contain a communication element, such as an NFC element, for the configuration tool and/or the circuit board to read or exchange information to confirm the presence of a specific configuration tool and/or specific circuit board. In some embodiments, the presence of physical contacts between the configuration tool and specific circuit board, as described below, enables LED programming of the microprocessor in the circuit board to occur.

Once inserted, the configuration tool may provide power to the circuit board at operation 304 via a battery in the configuration tool. In some embodiments, the circuit board may not have its own independent power source, instead relying on the configuration tool to power the microprocessor on the circuit board. The power provided by the battery via the power contact "wakes up" the microprocessor in the circuit board.

Once the microprocessor wakes up, at operation 306, the microprocessor determines whether the configuration tool is present. That is the microprocessor determines not only whether a tool is present, but in addition whether the tool is specifically the configuration tool. The connections of the contacts on the circuit board and the circuitry in the configuration tool enable the microprocessor to make this determination. In particular, the connection of the ground contact and the sink contact on the circuit board allows the grounding of the circuits in the configuration tool, thereby completing the configuration tool circuitry.

To determine whether the configuration tool is present at operation 306 in FIG. 3A, as shown at operation 330 in FIG. 3B, the microprocessor sends a voltage to the feedback contact. The voltage may be a randomly selected analog voltage or digital signal or may be a first in a predetermined set of analog voltages or digital signals (e.g., a predetermined bit pattern). In some embodiments, as the digital signal may carry more information than an analog signal, the digital signal may provide, in addition to selection of an LED configuration within a stored table, a selection of an alternate table already stored by the microprocessor, or may provide an entirely new table for storage and use by the microprocessor.

Because the feedback contact and the verification contact are connected in the configuration tool, the output of the circuit board supplied to the feedback contact is mirrored at the verification contact. Thus, the microprocessor reads the signal at the verification contact at operation 332.

The microprocessor, after reading the signal at the verification contact, at operation 334, compares the output supplied to the feedback contact with the input read at the verification contact.

If the voltage or bit pattern at the feedback contact and verification contacts match, the microprocessor assumes that the configuration tool is inserted. If the voltage or bit pattern at the feedback and verification contacts do not match, the microprocessor determines that a different tool is inserted and continues on to its normal operation at operation 308 without programming the LEDs. If there is a match, the microprocessor, at operation 310, configures its I/O pins for operation with the configuration tool.

In some embodiments, as shown in FIG. 3B, the verification process may be performed by the configuration tool a predetermined number of times. That is, after determining that the voltage or bit pattern at the feedback contact and verification contacts match, the microprocessor at operation 336 determines whether a verification has occurred a predetermined number of times (N). If verification has not occurred a predetermined number of times, the microprocessor increments (or decrements) a verification counter (at operation 338) and returns to operation 330, where the microprocessor sets a new voltage or bit pattern to the feedback contact. If verification has occurred a predetermined number of times, the microprocessor, at operation 310, reconfigures its I/O pins for operation with the configuration tool. In this case, a single mismatch between the voltage or bit pattern at the feedback and verification contacts may be insufficient to trigger transition of the microprocessor to normal operation at operation 308. Instead, the microprocessor may keep count of the number of mismatches and if the number of mismatches exceeds the maximum allowable, the microprocessor may terminate the verification process and return to operation 308.

After configuring the I/O for the pins for operation with the configuration tool at operation 310, whether or not repetition of the verification process is used, the microprocessor, at operation 312, generates a first feedback signal to indicate that the microprocessor has recognized the presence of the configuration tool. As shown, the first feedback signal may activate the feedback circuit (LED) in the configuration tool. For example, the microprocessor may turn the LED on so that it is continuously illuminated. In other embodiments, the microprocessor may activate the LED in a different manner (e.g., pulse the LED so that the LED blinks) and/or, as discussed above, may instead or in addition activate other feedback.

At operation 314, the microprocessor, in addition, measures the LED programming information, which is the analog voltage shown in FIG. 1. The microprocessor may then determine, at operation 316, whether the LED programming information matches valid information in the table. The microprocessor determines whether the LED programming information analog value lies within one of a range of one of predetermined analog values, each analog value corresponding to a different configuration having a different set of LED parameters.

If the microprocessor determines that the value is within the bounds of the table, at operation 320, the microprocessor writes the value into memory to use to operate the LEDs. The microprocessor then verifies whether the value has been correctly written into the memory at operation 322.

If the microprocessor verifies that the value matches the LED programming information, the microprocessor, at operation 324, sends a second feedback signal to the configuration tool for the feedback circuit to indicate successful programming. As shown in FIG. 3A, the second feedback signal may cause the LED on the configuration tool to blink at a predetermined rate. On the other hand, if the microprocessor is unable to verify that the correct value has been written, or if the microprocessor determines that the LED programming information is out of bounds of the table, the microprocessor, at operation 318, sends a third feedback signal to the configuration tool for the feedback circuit to indicate unsuccessful programming of the microprocessor. As shown in FIG. 3A, the third feedback signal may deactivate the LED on the configuration tool. As above, the second and third feedback signal are different from the first feedback signal and from each other. As with the first feedback signal, the second and/or third feedback signal may cause the configuration tool to provide audible and/or tactile feedback instead of, or in addition to, visual feedback.

In some embodiments operations 316 to 324 may occur at different times. For example, $10^6$ analog signals/second may be provided by the microprocessor, allowing the microprocessor to test whether the configuration tool is properly connected by testing the feedback/verification connection as the microprocessor is waiting for each analog signal. This permits each analog signal to be verified by the microprocessor by the time the analog signal is complete. Once the analog signal is verified, the analog signal is matched to the table. If a predetermined number (e.g., 10, 100, 1000) of the analog signals match up to the same table entry, the microprocessor determines that the analog signal is valid LED programming information. If the predetermined number does not match, the microprocessor tries again.

Figure 3C:
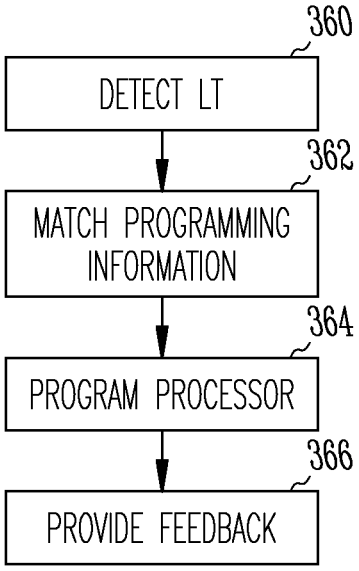
FIG. 3C shows a flowchart of a method of programming LEDs performed by a circuit board in accordance with some embodiments.
Figure 3D:
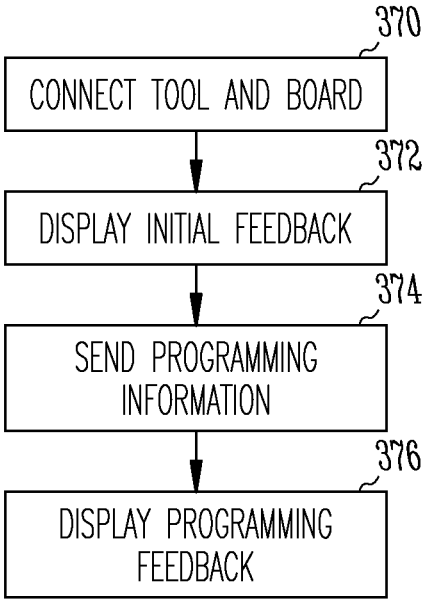
FIG. 3D shows a flowchart of a method of programming LEDs performed by a configuration tool in accordance with some embodiments.

FIG. 3C shows a flowchart of a method of programming LEDs performed by a circuit board in accordance with some embodiments. FIG. 3D shows a flowchart of a method of programming LEDs performed by a configuration tool in accordance with some embodiments. The operations shown in FIG. 3C may be implemented by the microprocessor, which may have loaded the instructions for the operations from nonvolatile memory to volatile memory, and afterwards started executing the instructions. The operations shown in FIG. 3D may be implemented by the configuration tool. The method shown here may include one or more operations, functions, or actions illustrated by one or more blocks. Although the blocks are illustrated in sequential order, these blocks may also be performed in parallel and/or in a different order than those described herein. Also, the various blocks may be combined into fewer blocks, divided into additional blocks, and/or eliminated based upon the desired implementation.

As shown in FIG. 3C, the method includes the microprocessor detecting at operation 360 that a tool connected to the circuit board is the LED configuration tool. After detecting that the configuration tool is connected to the circuit board, at operation 362 the microprocessor receives LED programming information from the configuration tool. The value provided by the configuration tool is indexed using a range of values in an LED setting table associated with different configurations to operate the LEDs. The microprocessor at operation 364 is then programmed to operate using the configuration indicated by the LED programming information, and at operation 366 provides, to the configuration tool, feedback that indicates whether the microprocessor was successfully programmed.

As shown in FIG. 3D, the method includes connecting the configuration tool to the LED circuit board comprising the LED microprocessor at operation 370. The LED circuit board is installed at an on-site location (e.g., a grocery store or other place of business or commerce, or municipal lighting such as a lamppost). At operation 372 the configuration tool displays, using feedback circuitry, initial feedback from the LED microprocessor indicating that the configuration tool and the LED microprocessor are connected. At operation 374, the configuration tool transmits LED programming information to program the LED microprocessor. The LED programming information is associated with a configuration used to operate LEDs controlled by the LED microprocessor. At operation 376, the configuration tool displays using the feedback circuitry programming feedback, received from the LED microprocessor, indicating a status of programming the microprocessor (successful or unsuccessful).

Figure 4A:
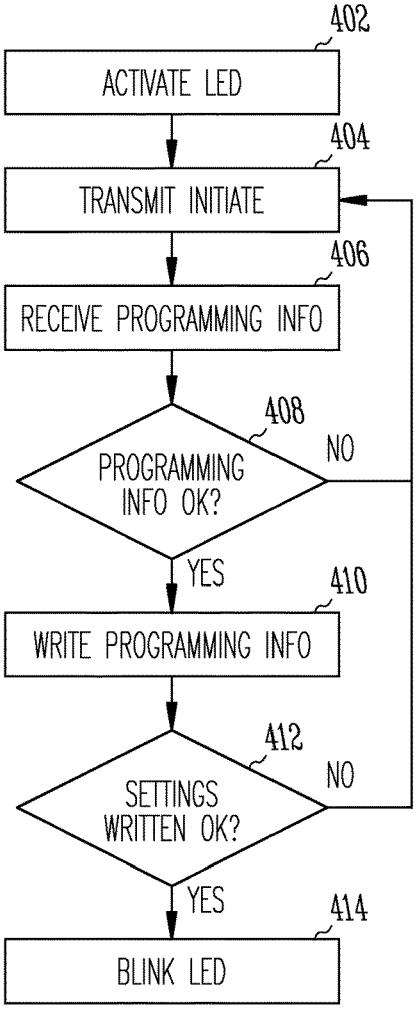
FIG. 4A shows a flowchart of another method of programming LEDs performed by a circuit board in accordance with some embodiments.
Figure 4B:
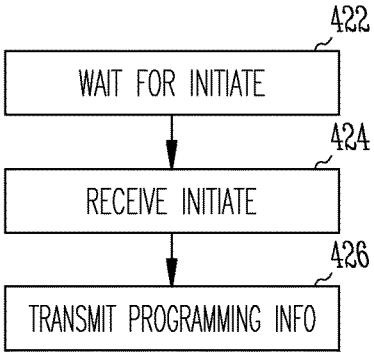
FIG. 4B shows a flowchart of the method shown by FIG. 4A for the configuration tool in accordance with some embodiments.

FIG. 4A shows a flowchart of another method of programming LEDs performed by a circuit board in accordance with some embodiments. FIG. 4B shows a flowchart of the method shown by FIG. 4A for the configuration tool in accordance with some embodiments. FIGS. 4A and 4B correspond to the system shown in FIG. 2, in which the configuration tool provides a digital signal as the LED programming information rather than providing an analog signal as the LED programming information as in FIG. 1. Accordingly, the operations shown in FIG. 4A may be implemented by the microprocessor on the circuit board, while the operations of FIG. 4B may be implemented by the microprocessor on the configuration tool, each of which may have loaded the instructions for the operations from nonvolatile memory to volatile memory, and afterwards started executing the instructions. The method shown here, and any method described herein, may include one or more operations, functions, or actions illustrated by one or more blocks. Although the blocks are illustrated in sequential orders, these blocks may also be performed in parallel, and/or in a different order than those described herein. Also, the various blocks may be combined into fewer blocks, divided into additional blocks, and/or eliminated based upon the desired implementation. Some of the operations shown in FIG. 3A, while present, are not shown for convenience.

As above, after the configuration tool provides battery power to the circuit board via the power contact, thereby waking the microprocessor in the circuit board, the microprocessor determines whether the configuration tool is present in the same manner as discussed above with respect to FIG. 3A. If the voltage or bit pattern at the feedback contact and verification contact match, the microprocessor assumes that the configuration tool is inserted and, in response, at operation 402, generates a first feedback signal to indicate that the microprocessor has recognized the presence of the configuration tool. As shown, the first feedback signal may activate the feedback circuit (LED) in the configuration tool. For example, the microprocessor may turn the LED on so that it is continuously illuminated.

Unlike the method of FIG. 3A, however, the microprocessors in the circuit board and the configuration tool communicate in the method shown in FIG. 4A. Specifically, rather than merely reading the analog voltage provided by the variable resistor (e.g., LED programming information) of FIG. 1, the microprocessor in the circuit board, at operation 404, transmits an initiation signal to the microprocessor in the configuration tool via the feedback contact. The initiation signal may include more information than merely a request (e.g., predetermined bit pattern) to initiate transmission of the LED programming information. For example, the initiation signal may include a serial number of the circuit board, version number of software in the microprocessor, or current LED configuration. This data may be used by the microprocessor in the configuration tool to determine which bit pattern to use or whether the circuit board is able to use the LED programming information. The data may also include other information, such as maintenance information, for example hours of use or recorded faults.

At operation 422 in FIG. 4B, the microprocessor in the configuration tool waits for reception of the initiation signal from the microprocessor in the circuit board. When the initiation signal is received by the microprocessor in the configuration tool at operation 424, at operation 426, the bit pattern for the LED programming information is transmitted to the microprocessor in the circuit board via the programming contact. The configuration tool may also provide additional information, such as the serial number of the configuration tool. The microprocessor in the configuration tool may avoid transmission of the LED programming information if, for example, the current LED configuration sent by the microprocessor in the circuit board in the initiation signal indicates the same configuration as that to be supplied by the configuration tool.

The microprocessor in the circuit board receives the LED programming information at operation 406 in FIG. 4A and then determines, at operation 408, whether the LED programming information matches valid information in the table in a manner similar to that provided above.

If the microprocessor in the circuit board determines that the LED programming information is within the bounds of the table, at operation 410, the microprocessor in the circuit board writes the value into memory, which is used to operate the LEDs. The microprocessor in the circuit board then verifies whether the value has been correctly written into the memory at operation 412.

If the microprocessor in the circuit board verifies that the value matches the LED programming information, the microprocessor in the circuit board at operation 414 sends a second feedback signal to the configuration tool for the feedback circuit to indicate successful programming. If the microprocessor in the circuit board is unable to verify that the correct value has been written at operation 412, or if the microprocessor in the circuit board determines that the LED programming information is out of bounds of the table at operation 408, the microprocessor in the circuit board returns to operation 404, retransmitting the initiation signal to the microprocessor in the configuration tool.

In some embodiments, the microprocessor in the circuit board and/or configuration tool may maintain a counter of the number of attempts to program the microprocessor in the circuit board. In this case, if programming failures exceed a predetermined number of times, the microprocessor in the circuit board may not send another initiation signal until a different configuration tool is connected (e.g., based on the additional data sent by the microprocessor in the configuration tool) and/or the microprocessor in the configuration tool may not transmit the LED programming information. Alternatively, the microprocessor in the configuration tool may transmit a bit pattern indicating excessive failure and that no further programming attempts will occur, or the microprocessor may attempt to send different LED programming information. The microprocessor in the circuit board and/or configuration tool may alert the operator as to the failure (e.g., via feedback circuitry).

Figure 5B:
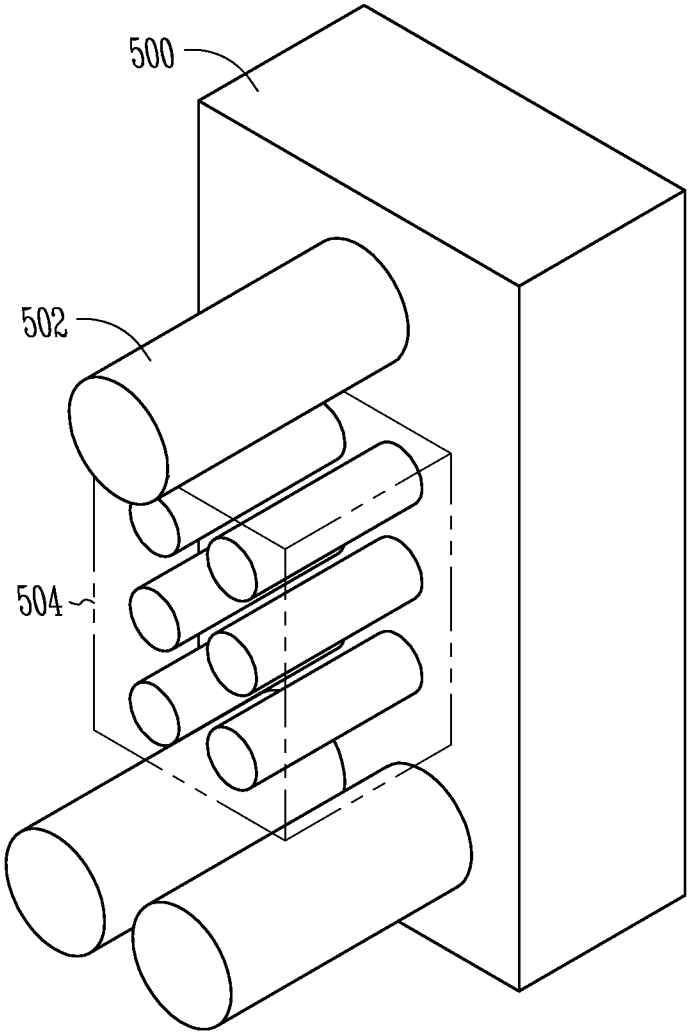
FIG. 5B shows a perspective view of the plug shown in FIG. 5A in accordance with some embodiments.
Figure 5A:
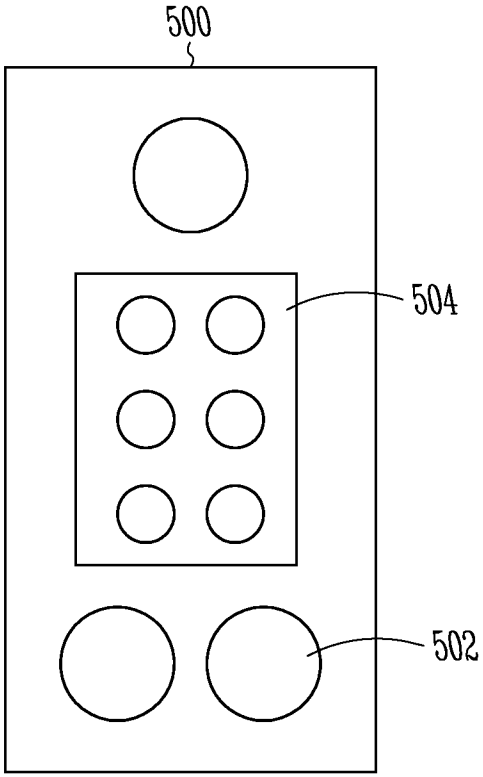
FIG. 5A shows a front view of a plug of the configuration tool in accordance with some embodiments.

FIG. 5A shows a front view of a plug 500 of the configuration tool in accordance with some embodiments. FIG. 5B shows a perspective view of the plug 500 shown in FIG. 5A in accordance with some embodiments. As shown, (active) contacts 504 on the plug 500 of the configuration tool may be formed from six pins. These pins include the verification contact, the power contact, the ground contact, the programming contact, the feedback contact, and the sink contact describe above. In addition, the plug 500 contains guide contacts 502 on opposing ends of the plug 500. The guide contacts 502 couple with corresponding guide contacts of the circuit board to ensure connection between the active contacts 504 with corresponding active contacts of the circuit board. The guide contacts 502 are asymmetric; different numbers of the guide contacts 502 disposed on opposing ends of the active contacts 504—one guide contact 502 on one end and two guide contacts 502 on the other end. The guide contacts 502 also have a different size than the active contacts 504.

Figure 6:
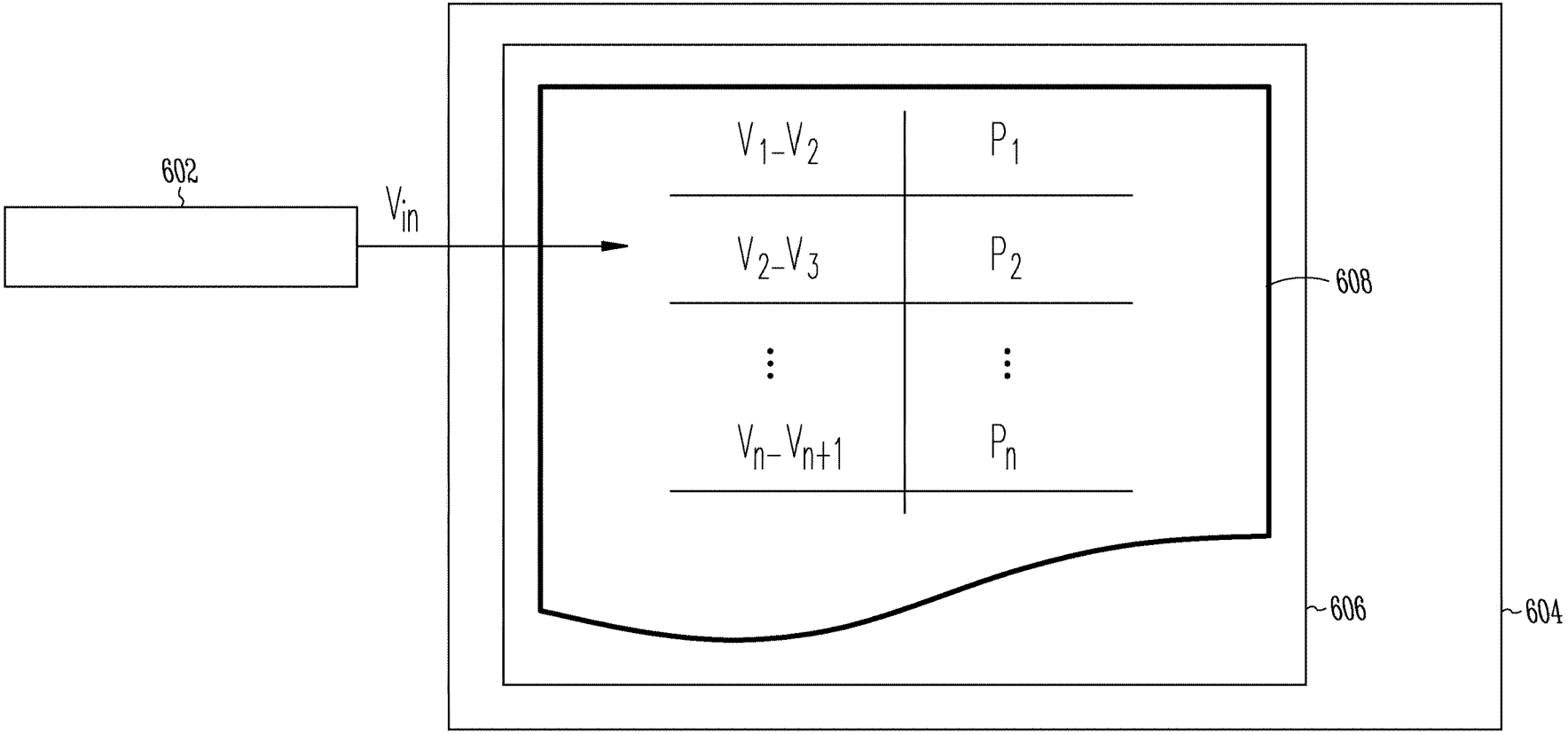
FIG. 6 shows a table and configurations used to operate the LEDs in accordance with some embodiments.

FIG. 6 shows a table and configurations used to operate the LEDs in accordance with some embodiments. As illustrated, the input value (Vin), an analog voltage in this example, is supplied from the configuration tool 602 to the microprocessor 606 on the circuit board 604. The microprocessor 606 contains a table 608 in which ranges of input values (or discrete input values) are associated with a value that is associated with an LED configuration of multiple parameters to operate the LEDs. The microprocessor 606 attempts to match the input value to one of the ranges of input values in the table 608. Error ranges exist between valid ranges (e.g., select among one of eight configurations), and produce an error feedback indicating an error to the configuration tool 602. The ranges may be independent of each other. If the input value is indexed to one of the ranges of input values in the table 608, the microprocessor 606 programs the LEDs to use the configuration associated with the range and provides feedback to the configuration tool 602 that the programming was successful. As shown, the end points are set as errors due to the likelihood that a maximum or minimum value could be caused by a short to another pin on the connector. The algorithm reads the analog value multiple times (within a few milliseconds) and may require that the result stays within the bounds of a particular value for the entire time. If so, that is the value that is programmed in. If the input value does not match one of the ranges of input values in the table 608, the microprocessor 606 provides feedback to the configuration tool 602 that the programming was unsuccessful. An example table is provided below:

| Center | Min | Max | Result |
|---|---|---|---|
| 0.000 | 0.000 | 0.094 | Error |
| 0.188 | 0.094 | 0.281 | Value A |
| 0.375 | 0.281 | 0.469 | Error |
| 0.563 | 0.469 | 0.656 | Value B |
| 0.750 | 0.656 | 0.844 | Error |
| 0.938 | 0.844 | 1.031 | Value C |
| 1.125 | 1.031 | 1.219 | Error |
| 1.313 | 1.219 | 1.406 | Value D |
| 1.500 | 1.406 | 1.594 | Error |
| 1.688 | 1.594 | 1.781 | Value E |
| 1.875 | 1.781 | 1.969 | Error |
| 2.063 | 1.969 | 2.156 | Value F |
| 2.250 | 2.156 | 2.344 | Error |
| 2.438 | 2.344 | 2.531 | Value G |
| 2.625 | 2.531 | 2.719 | Error |
| 2.813 | 2.719 | 2.906 | Value H |
| 3.000 | 2.906 | 3.000 | Error |

Figure 7:
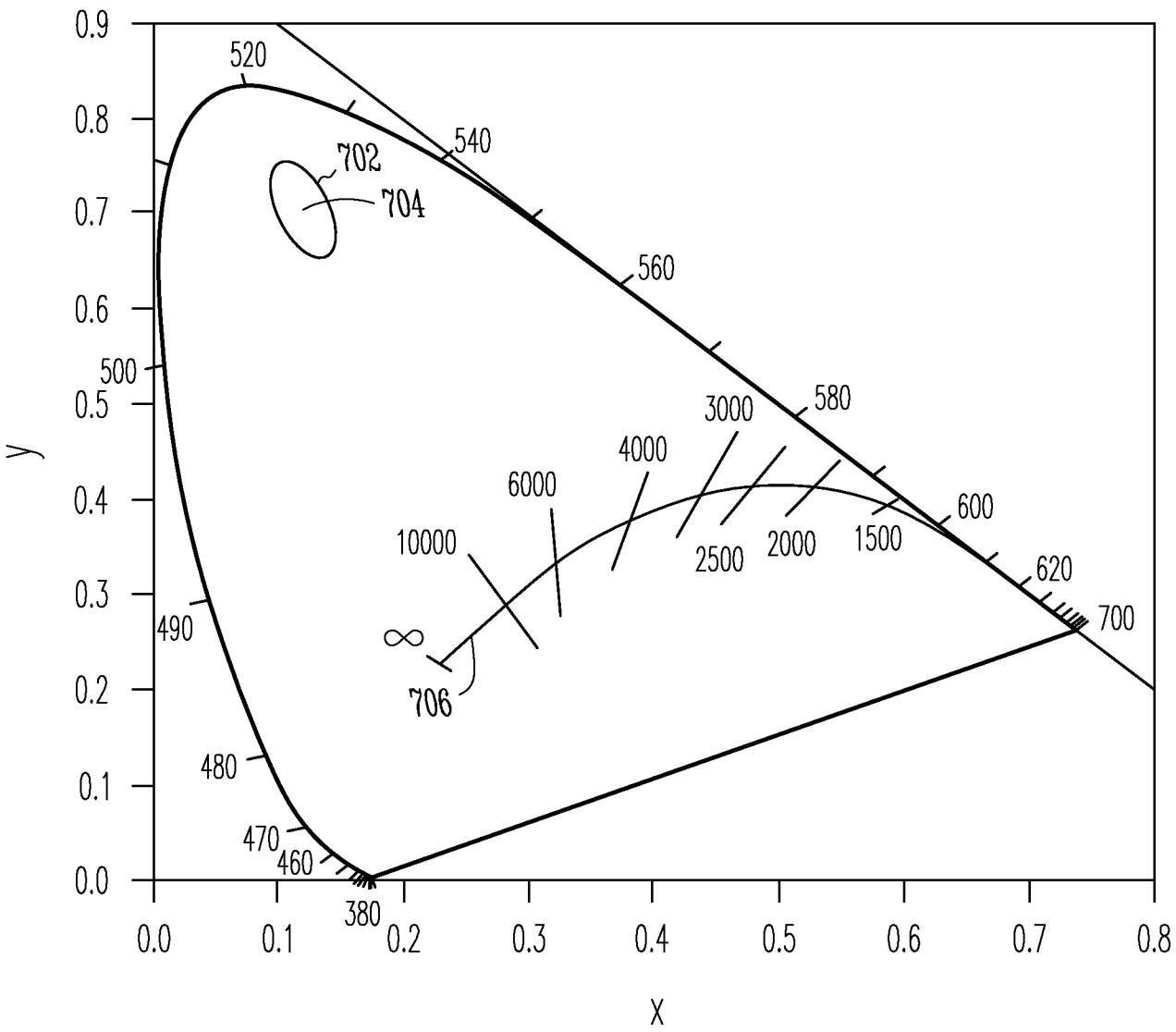
FIG. 7 is a chromaticity diagram representing a color space in accordance with some embodiments.
Figure 8:
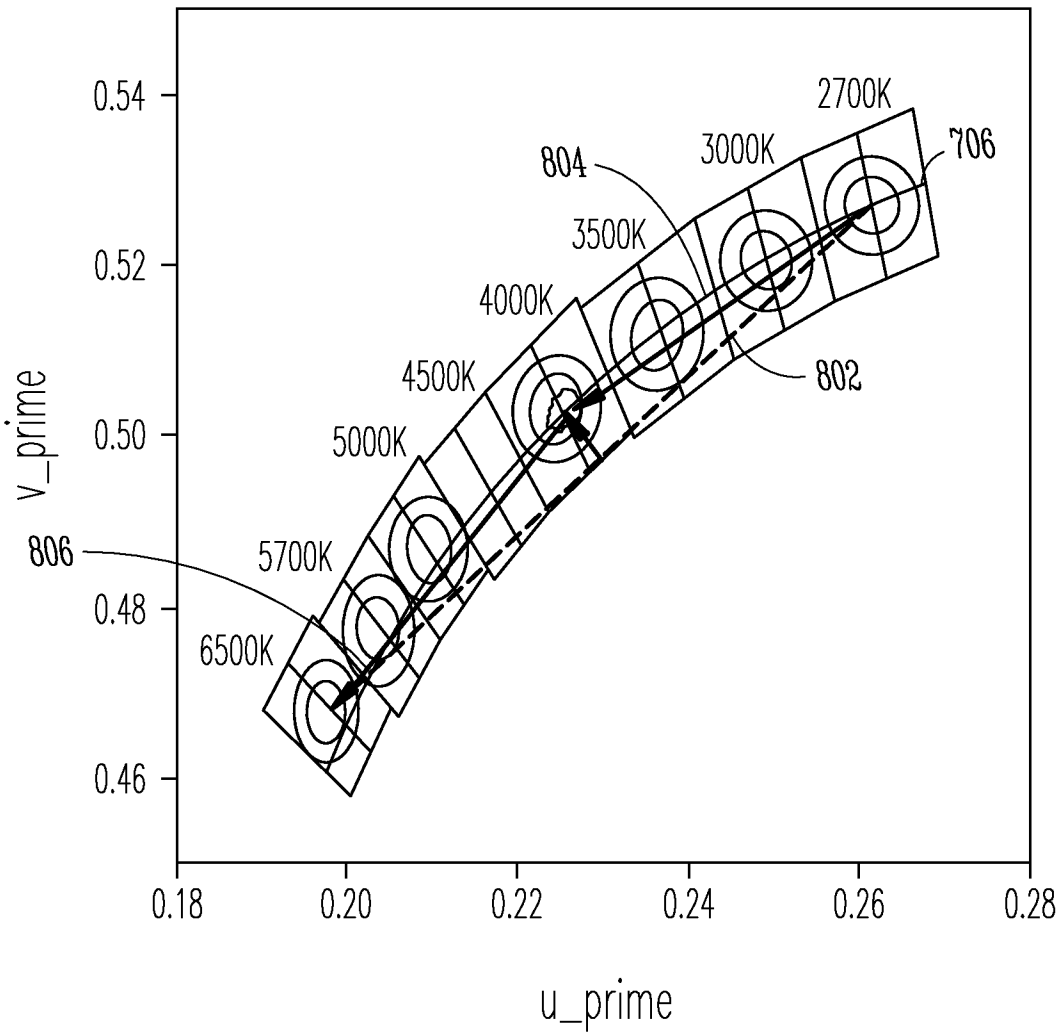
FIG. 8 is a diagram illustrating different correlated color temperatures (CCTs) and their relationship to a black body line (BBL) on the chromaticity diagram in accordance with some embodiments.

As discussed above, the table of the microprocessor in the circuit board may include various parameters related to providing specific features for not only individual LEDs but sets of LEDs that combine to form different colors. FIG. 7 is a chromaticity diagram representing a color space. FIG. 8 is a diagram illustrating different correlated color temperatures (CCTs) and their relationship to a black body line (BBL) on the chromaticity diagram.

Referring to FIG. 7, a chromaticity diagram representing a color space is shown. A color space is a three-dimensional space; that is, a color is specified by a set of three numbers that specify the color and brightness of a particular homogeneous visual stimulus. The three numbers may be the International Commission on Illumination (CIE) coordinates X, Y, and Z, or other values such as hue, colorfulness, and luminance. Based on the fact that the human eye has three different types of color sensitive cones, the response of the eye is best described in terms of these three "tristimulus values".

A chromaticity diagram is a color projected into a two-dimensional space that ignores brightness. For example, the standard CIE XYZ color space projects directly to the corresponding chromaticity space specified by the two chromaticity coordinates known as x and y, as shown in FIG. 7.

Chromaticity is an objective specification of the quality of a color regardless of its luminance. Chromaticity consists of two independent parameters, often specified as hue and colorfulness, where the latter is alternatively called saturation, chroma, intensity, or excitation purity. The chromaticity diagram may include all the colors perceivable by the human eye. The chromaticity diagram may provide high precision because the parameters are based on a spectral power distribution (SPD) of the light emitted from a colored object and are factored by sensitivity curves which have been measured for the human eye. Any color may be expressed precisely in terms of the two-color coordinates x and y.

All colors within a certain region, known as a MacAdam ellipse (MAE) 702, may be indistinguishable to the average human eye from the color at the center 704 of the ellipse. The chromaticity diagram may have multiple MAEs. Standard Deviation Color Matching in LED lighting uses deviations relative to MAEs to describe color precision of a light source.

The chromaticity diagram includes the Planckian locus, or the BBL 606. The BBL 606 is the path or locus that the color of an incandescent black body would take in a particular chromaticity space as the blackbody temperature changes. It goes from deep red at low temperatures through orange, yellowish white, white, and finally bluish white at very high temperatures. Generally speaking, human eyes prefer white color points not too far away from the BBL 706. Color points above the black body line would appear too green while those below would appear too pink.

One method of creating white light using LEDs may be to additively mix red, green, and blue colored lights. However, this method may require precise calculation of mixing ratios so that the resulting color point is on or close to the BBL 706. Another method may be to mix two or more phosphor converted white LEDs of different CCTs.

To create a tunable white light engine, LEDs having two different CCTs on each end of a desired tuning range may be used. For example, a first LED may have a CCT of 2700K, which is a warm white, and a second LED may have a color temperature of 4000K, which is a neutral white. White colors having a temperature between 2700K and 4000K may be obtained by simply varying the mixing ratio of power provided to the first LED through a first channel of a driver and power provided to the second LED through a second channel of the driver.

Referring now to FIG. 8, a diagram illustrating different CCTs and their relationship to the BBL 706 is shown. When plotted in the chromaticity diagram, the achievable color points of mixing two LEDs with different CCTs may form a first straight line 802. Assuming the color points of 2700K and 4000K are exactly on the BBL 706, the color points in between these two CCTs would be below the BBL 706. This may not be a problem, as the maximum distance of points on this line from the BBL 706 may be relatively small.

However, in practice, it may be desirable to offer a wider tuning range of color temperatures between, for example, 2700K and 6500K, which may be cool white or day light. If only 2700K LEDs and 6500K LEDs are used in the mixing, the first straight line 802 between the two colors may be far below the BBL 706. As shown in FIG. 8, the color point at 4000K may be very far away from the BBL 606.

To remedy this, a third channel of neutral white LEDs (4000K) may be added between the two LEDs and a 2-step tuning process may be performed. For example, a first step line 804 may be between 2700K and 4000K and a second step line 806 may be between 4000K and 6500K. This may provide 3-step MAE BBL color temperature tunability over a wide range of CCTs. A first LED array having a warm white (WW) CCT, a second LED array having a neutral white (NW) CCT, and a third LED array having a cool white (CW) CCT and a two-step tuning process may be used to achieve three-step MAE BBL CCT tunability over a wide range of CCTs. The parameters stored in the table of the microprocessor in the circuit board may be used to provide a configuration of white, or any other color of light, according to these features.

In some embodiments, the configuration tool may be limited in the number of times that the LED programming information, whether analog or digital, is provided. To this end, the configuration tool may have a counter that increments or decrements each time the configuration tool is connected with an appropriate circuit board (and thus the LED programming information is provided). In this case, after connection to the circuit board and prior to providing the LED programming information, the configuration tool determines whether additional instances of providing the LED programming information remain. If so, the process may continue as shown in FIG. 3A. If not, however, the configuration tool may bar the LED programming information from being provided and provide feedback to the operator that the license to use the configuration tool is to be recharged. As discussed above, this feedback may be provided locally (e.g., visually, audibly and/or tactilely) and/or may be provided via wireless communication (e.g., email, text message) if the configuration tool has the capability for wireless communication. In this latter case, the configuration tool may also transmit an end-of-license indication to the licensor. The configuration tool may be able to be remotely re-licensed by the licensor (e.g., via connecting the configuration tool to a computer or directly over the air). To prevent addition transmissions of the LED programming information, the microprocessor in the configuration tool may disallow transmissions of the digital data in the digital programming circuitry or the configuration tool may disconnect the connection to the power, programming contact, and/or sink contact via a switch in any of the connections to the analog programming circuitry. In other embodiments, the determination of whether additional instances of providing the LED programming information remain may occur after verification of programming the microprocessor. In some embodiments, the number of licenses may be recharged using a special tool connected to the feedback contact to provide, for example, a predetermined bit pattern to the microprocessor in the configuration tool. In some embodiments, the LED programming information may be encrypted to limit programming to authorized microprocessors.

In further embodiments, the configuration tool may have a locator, such as GPS. The configuration tool may be preprogrammed to operate only in one or more predetermined geographical areas. As discussed above, feedback may be provided to the operator and/or licensor if the tool is attempted to be activated outside the predetermined geographical areas.

While exemplary embodiments of the present disclosed subject matter have been shown and described herein, it will be obvious to those skilled in the art that such embodiments are provided by way of example only. Numerous variations, changes, and substitutions will now occur to those skilled in the art, upon reading and understanding the material provided herein, without departing from the disclosed subject matter. It should be understood that various alternatives to the embodiments of the disclosed subject matter described herein may be employed in practicing the various embodiments of the subject matter. It is intended that the following claims define the scope of the disclosed subject matter and that methods and structures within the scope of these claims and their equivalents be covered thereby.

It will thus be evident that various modifications and changes may be made to these aspects without departing from the broader scope of the present disclosure. Accordingly, the specification and drawings are to be regarded in an illustrative rather than a restrictive sense. The accompanying drawings that form a part hereof show, by way of illustration, and not of limitation, specific aspects in which the subject matter may be practiced. The aspects illustrated are described in sufficient detail to enable those skilled in the art to practice the teachings disclosed herein. Other aspects may be utilized and derived therefrom, such that structural and logical substitutions and changes may be made without departing from the scope of this disclosure. This Detailed Description, therefore, is not to be taken in a limiting sense, and the scope of various aspects is defined only by the appended claims, along with the full range of equivalents to which such claims are entitled.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single aspect for the purpose of streamlining the disclosure. This method of disclosure is not to be interpreted as reflecting an intention that the claimed aspects require more features than are expressly recited in each claim. Rather, as the following claims reflect, inventive subject matter lies in less than all features of a single disclosed aspect. Thus, the following claims are hereby incorporated into the Detailed Description, with each claim standing on its own as a separate aspect.

What is claimed is:

1. A method of programming a light emitting diode (LED) microprocessor that controls operations of LEDs, the method comprising:

detecting coupling of an LED configuration tool to a circuit board comprising the LED microprocessor;

receiving LED programming information from the LED configuration tool;

determining whether the LED programming information corresponds to one of a plurality of different values of an LED setting table stored in the LED microprocessor, the plurality of different values associated with different configurations to operate the LEDs, the LED setting table containing valid ranges associated with the different values and invalid ranges associated with an error, adjacent valid ranges separated by one of the invalid ranges; and programming the LED microprocessor to operate the LEDs using an LED configuration associated with a particular value to operate the LEDs based on a determination that the LED programming information is within one of the valid ranges in the LED setting table corresponding to the particular value.

2. The method of claim 1, further comprising:

based on a determination that the LED programming information from the LED configuration tool is within one of the ranges in the LED setting table corresponding to the particular value, returning an indication of successful programming of the LEDs to the LED configuration tool.

3. The method of claim 1, further comprising:

based on a determination that the LED programming information from the LED configuration tool is within one of the ranges in the LED setting table corresponding to the error, returning an indication of a programming error to the LED configuration tool.

4. The method of claim 1, wherein each configuration provides at least one operation selected from a correlated color temperature (CCT), $D_{uv}$ value, flux, dimming curve, warm-dimming curve, wake-up curve, and a daylight CCT following to operate the LEDs.

5. The method of claim 1, further comprising:

determining whether the LED programming information from the LED configuration tool is an analog voltage; and using the LED configuration associated with the particular value to operate the LEDs based on a determination that the analog voltage is within one of the valid ranges in the LED setting table corresponding to the particular value.

6. The method of claim 1, further comprising:

determining whether the LED programming information from the LED configuration tool comprises a digital signal; and based on a determination that the LED programming information from the LED configuration tool comprises a digital signal and the digital signal corresponds to a value of the LED setting table associated with the particular configuration, using the particular configuration to operate the LEDs.

7. The method of claim 6, further comprising:

based on a determination that the LED programming information from the LED configuration tool comprises the digital signal, determining whether the LED programming information from the LED configuration tool further comprises a new LED setting table; and based on a determination that the LED programming information from the LED configuration tool further comprises a new LED setting table:

replacing an existing LED setting table stored in the LED microprocessor with the new LED setting table, and using a particular configuration of the new LED setting table associated with the digital signal to operate the LEDs.

8. The method of claim 6, further comprising:

after detecting that the LED configuration tool is connected to the circuit board, sending, to the LED configuration tool, an initiation request; and receiving the LED programming information in response to transmission of the initiation request.

9. The method of claim 1, wherein:

the circuit board comprises a first circuit board contact and a second circuit board contact; and the method further comprises:

sending at least one signal through the first circuit board contact to the LED configuration tool; and determining that the LED configuration tool is coupled to the circuit board based on determining that the at least one signal is present at the second circuit board contact to the LED configuration tool.

10. The method of claim 9, further comprising the LED microprocessor:

providing, to the LED configuration tool, feedback that indicates whether the LED microprocessor was successfully programmed; and sending the feedback through the first circuit board contact.

11. The method of claim 9, further comprising:

sending multiple signals consecutively through the first circuit board contact; and determining that the LED configuration tool is connected to the circuit board after determining that each of the multiple signals is present at the second circuit board contact.

12. The method of claim 11, further comprising the LED microprocessor:

randomly selecting each of the signals to send through the first circuit board contact.

13. The method of claim 1, further comprising:

writing the LED configuration to a memory;

repeatedly determining whether the LED configuration has been correctly written until a predetermined condition has been reached; and indicating the status of programming of the LED microprocessor as successful in response to a predetermined number of determinations that the LED configuration has been correctly written.

14. The method of claim 1, further comprising:

waking up the LED microprocessor using power supplied from the LED configuration tool.

15. The method of claim 1, further comprising:

reconfiguring an input/output arrangement specific to the LED configuration tool in response to determining that the LED configuration tool is coupled to the circuit board.

16. The method of claim 15, further comprising:

sending initial feedback to the LED configuration tool indicating that the LED configuration tool has been determined to be coupled to the LED microprocessor; and providing, to the LED configuration tool, programming feedback that indicates the microprocessor was successfully programmed, the programming feedback being different from the initial feedback.

17. A method of operating a light emitting diode (LED) configuration tool, the method comprising the LED configuration tool:

transmitting LED programming information, in response to the LED configuration tool being coupled to an LED circuit board comprising a LED microprocessor and installed at an on-site location, to program the LED microprocessor, the LED programming information corresponding to a value in an LED setting table stored in the LED microprocessor, the LED setting table containing valid ranges associated with different values and invalid ranges associated with an error, adjacent valid ranges separated by one of the invalid ranges, the value associated with one of a plurality of LED configurations that is used to operate LEDs controlled by the LED microprocessor; and providing programming feedback, received from the LED microprocessor, indicating a status of programming the microprocessor.

18. The method of claim 17, further comprising the LED configuration tool:

providing initial feedback, received from the LED microprocessor indicating that the LED microprocessor has determined that the LED configuration tool is coupled to the LED microprocessor and receiving the initial feedback and the programming feedback from a same contact in a plug electrically coupling the LED configuration tool and the LED microprocessor the programming feedback different from the initial feedback.

19. The method of claim 17, further comprising the LED configuration tool:

receiving an initiation request from the LED microprocessor at an LED configuration tool microprocessor; and transmitting the LED programming information by the LED configuration tool microprocessor in response to receiving the initiation request, the LED programming information comprising a digital signal used to select one of the LED configurations to operate LEDs from LED configurations in an LED setting table stored in the LED microprocessor.

20. The method of claim 17, further comprising the LED configuration tool:

receiving an initiation request from the LED microprocessor at an LED configuration tool microprocessor; and transmitting the LED programming information by the LED configuration tool microprocessor in response to receiving the initiation request, the LED programming information comprising a new LED setting table comprising the LED configurations to replace an LED setting table stored in the LED microprocessor and a digital signal used to select, from the new LED setting table, one of a plurality of LED configurations to operate LEDs.

21. The method of claim 17, wherein:

the LED programming information is an analog voltage that corresponds to a value of an LED setting table associated with a particular configuration.

22. The method of claim 17, further comprising:

supplying power to the LED microprocessor to wake up the LED microprocessor prior to programming the LED microprocessor.

23. The method of claim 17, wherein:

each LED configuration provides at least one of a correlated color temperature (CCT) and Duv, flux, dimming curve, warm dimming curve, wake-up curve, or daylight CCT following.

24. A tangible computer-readable storage medium, having no transitory signals, that stores instructions for execution by processing circuitry to perform operations for programming, in a light emitting diode (LED) circuit board, an LED microprocessor that controls operation of LEDs, the operations to configure the processing circuitry to:

detect coupling of an LED configuration tool to a circuit board comprising the LED microprocessor;

receive LED programming information from the LED configuration tool;

determine whether the LED programming information corresponds to a value, in an LED setting table stored in the LED microprocessor, associated with an LED configuration, the LED setting table having valid ranges that each correspond to a different value associated with a different LED configuration and invalid ranges that each correspond to an error, the valid ranges separated by the invalid ranges; and in response to a determination that the LED programming information corresponds to a value associated with one of the valid ranges, use the LED configuration associated with the value to operate the LEDs.

* * * * *